252-104 AU 166 EX
12/16/80 XR 4,239,640

United States Patent [19]
Williams et al.
[11] 4,239,640
[45] Dec. 16, 1980

[54] MANUFACTURE OF DETERGENTS

[75] Inventors: Thomas A. Williams, Beckermet; Douglas E. Mather, Hillcrest, both of England

[73] Assignee: Albright & Wilson Ltd., Oldbury, England

[21] Appl. No.: 847,379

[22] Filed: Oct. 31, 1977

[30] Foreign Application Priority Data

Nov. 2, 1976 [GB] United Kingdom ..... 45509/76

[51] Int. Cl.² ..... C11D 7/54
[52] U.S. Cl. ..... 252/95; 252/99; 252/104; 252/135; 252/174.21; 427/220
[58] Field of Search ..... 252/95, 99, 104, 89, 252/135; 427/220

[56] References Cited

U.S. PATENT DOCUMENTS

| | | | |
|---|---|---|---|
| 3,741,904 | 6/1973 | Christensen et al. | 252/99 |
| 4,059,538 | 11/1977 | Green et al. | 252/95 |

*Primary Examiner*—Mayer Weinblatt
*Attorney, Agent, or Firm*—Frishauf, Holtz, Goodman & Woodward

[57] ABSTRACT

In the manufacture of detergent powders containing alkoxylated alcohols, the problem arises that the alcohols cannot be spray-dried with the rest of the constituents. The invention provides a method of incorporating the alcohols into the spray-dried powder in such a way that staining of the packages does not occur. This is done by adding the alcohols in the form of a solution which combines with the residual water in the powder to form a gel.

9 Claims, No Drawings

MANUFACTURE OF DETERGENTS

This invention relates to the manufacture of solid detergents consisting essentially of a builder, usually sodium tripolyphosphate, and a surfactant or mixture thereof. A number of other constituents are also normally present.

The method generally employed for producing solid powder detergents is to spray-dry an aqueous slurry of the mixture constituting the detergent. If, however, it is desired to use as the, or one of the, surfactants an alkoxylated alcohol in which the alcohol moiety has a carbon number from 10–18 and the degree of ethoxylation is 6–12 alkoxy radicles per molecule, difficulties arise because these compounds tend to volatilise and produce plumes during spray drying. Attempts have therefore been made to add the alkoxylated alcohol as an anhydrous liquid to a spray-dried mixture of the rest of the constituents, in the hope that the liquid would adhere to the powder and form a stable mixture. This method is not, however, successful in that a certain amount of liquid, probably consisting of a solution of the alkoxylated alcohol in the residual water contained in the spray-dried product, migrates to the surface and stains the package in which the detergent is stored, transported and sold.

This problem is wholly or largely overcome by our invention according to which the non-spray dryable alkoxylated alcohol constituent is added to the spray-dried powder in the form of an aqueous solution of such concentration that it is pumpable but which, when the residual water in the spray-dried powder is added to it, forms a gel, with the result that the solid mixture is more stable than if no water were present in the added liquid. While we do not wish to be bound by any theoretical explanation of this apparently anomalous effect, we believe that it may be due to the fact discovered by us that the curve of viscosity against concentration of aqueous solutions of the said alkoxylated alcohols has a pronounced maximum at concentrations in the region of 60%, and that the alcohol solution picks up the residual available water in the spray-dried product so as to produce a solution in the form of a gel having a concentration at or near the point of maximum viscosity.

As stated above, the non-spray dryable alkoxylated alcohols to which the invention is applied are those in which the alcohol moiety has 10–18 carbon atoms. Preferred are those with 12–16, especially 12–14 carbon atoms. The alkoxy moiety consists of a chain of alkoxy radicles, 6–12, preferably 8–10, molecules in length and preferably consisting of ethoxy radicles. Most preferred is a standard $C_{12}/C_{14}$ detergent grade alcohol with nominally 8 ethoxy radicles. The alcohol moiety may consist of a mixture of alcohols, in which case the carbon numbers given above refer to the predominant carbon number in the mixture.

The spray-dried mixture to which the alkoxylated alcohol solution is added may be a conventional formulation in which all or part of the surfactant is to be replaced by the alkoxylated alcohol. Typical constituents are as follows, the percentages being by weight:

| | |
|---|---|
| Builder: Sodium tripolyphosphate (including bound water) | 25 to 65% |
| Surfactant (other than non-spray dryable alkoxylated alcohol) | 0 to 15% |
| *Soap | 2 to 10% |

-continued

| | |
|---|---|
| *Sodium silicate | 4 to 15% |
| *Fluorescent brightener | 0.1 to 1% |
| Residual unbound water | 1 to 7% generally 2 to 5% |
| Sodium sulphate | Balance |

*Optional constituents

A bleaching agent such as sodium perborate or percarbonate (10–30%) and a perfume (0.1–0.3%), when used, are added after spray drying.

The amount of alkoxylated alcohol added to such a spray dried powder depends on the amount of surfactant desired in the finished product and the amount of other surfactant (if any) already present in the powder. Typical percentages of alcohol based on the total detergent formulation are in the range 5 to 10%.

The alkoxylated alcohol is added at a temperature of 10°–70° C. in the form of a solution containing water of such concentration that it is sufficiently fluid to be pumped through jets, but that when the residual unbound water in the spray-dried powder is combined with it, a mixture of the alkoxylated alcohol and water is formed of a concentration such as to produce a gel which does not migrate from the spray-dried powder. This latter concentration depends on the alcohol used, but may be in the range 50–70%, preferably 60%.

The desired concentration of the alkoxylated alcohol in the gel with water formed in the final product depends on the ambient temperature at which the product is to be stored, decreasing slightly with increasing temperatures. Since the addition of the alcohol solution is likely to take place before the spray-dried powder has completely cooled, the temperature at that stage will normally be above ambient, but this does not affect the desired concentration of the alcohol in the gel in the final product. An indication of the variation of the latter in the case of $C_{12/18}$ alcohol 8 mole ethoxylate with ambient storage temperatures is as follows: 65 to 60% at 30° C. and 55 to 40% at 40° C.

For a range of storage temperatures of 20° to 30° C., the preferred final concentration of the 8 mole ethoxylated alcohol in the gel (i.e. after uptake of residual water) varies from 65% to 60%.

The desired concentration of the alkoxylated alcohol in the gel also depends slightly on the molecular weight of the alcohol, increasing with decreasing molecular weight.

The invention is illustrated by the following Example, the percentages and parts being by weight in the Example and throughout the specification:

EXAMPLE

An aqueous slurry was made up as follows:

| | % by Weight |
|---|---|
| Fatty acid monoethanolamide | 3.75 |
| $C_{16-18}$ fatty alcohol 15 mole ethoxylate | 4.45 |
| Soap | 1.9 |
| Sodium tripolyphosphate | 30.5 |
| Sodium silicate (solids) | 7.0 |
| Sodium toluene sulphonate | 1.8 |
| Carboxy methyl cellulose | 1.8 |
| EDTA | 0.15 |
| Fluorescent brightener | 0.45 |
| Sodium sulphate | 8.2 |
| Water | 40 |

This slurry was spray-dried in conventional manner to give a powder with a residual water content of 10%. An aqueous solution of 65% concentration of an 8 mole ethoxylate of a coconut-based alcohol having the following composition:

| | |
|---|---|
| $C_{10}$ | 3.2% |
| $C_{12}$ | 57.7% |
| $C_{14}$ | 20.3% |
| $C_{16}$ | 7.5% |
| $C_{18}$ | 9.1% |

was sprayed on the powder at a temperature of about 25° C. at a rate of 7.7 parts to 70 parts of powder.

The resultant solid contained 6.4% ethoxylated alcohol which was present in the product as an immobile gel containing 57% ethoxylated alcohol and 43% water. 20% of sodium perborate and 0.2% of a perfume based on the total product were added.

We claim:

1. In the process for the manufacture of a solid powder detergent having as one constituent an ethoxylated alcohol or mixture thereof in which the average carbon number of the alcohol moiety is 10–18 and the average chain length of the polyethoxy moiety is 6–12 ethoxy radicals per molecule wherein said ethoxylated alcohol in liquid form is added to a spray-dried powder detergent mixture containing from 1 to 7% by weight residual unbound water, the improvement comprising mixing said ethoxylated alcohol in aqueous solution with said powder mixture, said ethoxylated alcohol in aqueous solution having a concentration of alcohol higher than the minimum at which a gel is formed and in sufficient proportion so that when admixed with said spray-dried mixture including said residual unbound water, said aqueous ethoxylated alcohol forms an immobile gel on the powders forming said spray-dried mixture.

2. A process as claimed in claim 1 in which the alcohol moiety has an average carbon number of 12–16.

3. The process of claim 1 wherein said residual unbound water is in an amount between 2 and 5 percent by weight of said spray-dried mixture and wherein said ethoxylated alcohol in aqueous solution is pumped through jets to form a spray and directing said spray on said powder mixture.

4. The process of claim 3 wherein said gel consists of water, and ethoxylated alcohol in an amount between 50% and 70% by weight of the gel and sufficient to form a gel.

5. The process of claim 3 wherein a perfume is added to said solid powder detergent after it has been sprayed with said ethoxylated alcohol.

6. The process of claim 3 wherein a bleaching agent is added to said solid powder detergent after it has been sprayed with said ethoxylated alcohol.

7. A process as claimed in claim 3 in which the average chain length of the ethoxy moiety is 8–10 ethoxy radicals per molecule.

8. A process as claimed in claim 3 in which the alcohol moiety has an average carbon number of 12–14.

9. A process as claimed in claim 8, in which the average chain length of the ethoxy moiety is 8–10 ethoxy radicals per molecule.

* * * * *